United States Patent [19]

Sax

[11] 4,280,234

[45] Jul. 28, 1981

[54] BATH AID

[76] Inventor: Hans Sax, Frauenfelderstrasse 81, Winterthur, Switzerland

[21] Appl. No.: 55,503

[22] Filed: Jul. 9, 1979

[30] Foreign Application Priority Data

Jul. 24, 1978 [CH] Switzerland ..... 7957/78

[51] Int. Cl.[3] ..... A47K 3/022; F24H 1/00; A47K 3/08

[52] U.S. Cl. ..... 4/540; 4/545; 4/573

[58] Field of Search ..... 4/173 R, 175, 176, 179, 4/185 S, 185 R, DIG. 6, 312, 514, 538, 540, 545, 546, 548–550, 554, 571, 573, 578, 590, 584, 592, 598

[56] References Cited

U.S. PATENT DOCUMENTS

| | | | |
|---|---|---|---|
| 746,390 | 12/1903 | Schmidt | 4/179 |
| 945,299 | 1/1910 | Williams | 4/179 |
| 1,839,156 | 12/1931 | Lumpkin | 4/DIG. 6 |
| 2,075,471 | 3/1937 | Sahloff | 4/179 |
| 2,569,825 | 10/1951 | Otis | 4/185 S |
| 3,534,748 | 10/1970 | Ekman | 4/185 R X |

FOREIGN PATENT DOCUMENTS

| | | | |
|---|---|---|---|
| 492438 | 8/1970 | Switzerland | 4/176 |

*Primary Examiner*—Stuart S. Levy
*Attorney, Agent, or Firm*—Ernest F. Marmorek

[57] ABSTRACT

A tub member is pivotable about a horizontal axis between an initial and an operative position, and is adapted to be filled with a bathing liquid, when in the operative position, and a chair member includes seat and backrest portions. At least one of the members may be moved relative to the other to and from a station of close contact. The tub member, when the members are in the station of close contact, is adapted to face the chair portions, and is pivotable to the operative position for receiving interiorly at least a portion of the chair within the tub member. The seat and backrest portions of the chair member define a chamber adapted to be filled with a fluid of a predetermined temperature.

7 Claims, 5 Drawing Figures

153
151
111
113
114
159
112
152
119
110
150
116
115
10
154
117
118
11
16
15
A

BATH AID

Background of the Invention

From Swiss patent CH-PS 492,438 there is known a bathing equipment, which includes a chair and a tub for non-ambulatory or near-nonambulatory patients, which may be pivoted about a horizontal axis between an operative or bathing position, when the chair is disposed in the tub, to an inactive or initial position, when the chair is to all intents and purposes disposed outside of the tub.

The empty tub originally occupies an initial, or standby position, and the non-ambulatory or near-nonambulatory person is placed, if necessary with the aid of nursing personnel, onto the chair. Subsequently the tub is pivoted to its bathing or operative position around the chair, and then filled with water. Following completion of the bath, the water is discharged through an outlet, and the tub returned to its initial position, at which time the non-ambulatory or near-nonambulatory patient is removed, if necessary with the aid of nursing personnel, from the chair. Equipment of this type has been highly regarded and proven in hospitals, as it permits the nursing personnel to be relieved of routine tasks, allows a high degree of comfort for the patient, while using a relatively simple equipment.

In the known equipment however, it takes, under normal water supply conditions, several minutes, before the tub can be filled, so that the patient to be bathed may start to shiver, before his body is surrounded by warm water. It is additionally to be noted that it is sometimes disagreeable for the patient to occupy a relatively cold seat, which cold seat may contribute to his possible shivering, while the water is let into the tub.

It has been found that this can be obviated in a surprisingly simple manner, and that the supply of hot water can be reduced by providing a tub member pivotable about a horizontal axis between an initial and an operative position, and adapted to be filled with a bathing liquid when in the operative position, and a chair member having seat and backrest portions; at least one of the members may be moved relative to the other to and from a station of close contact. The tub member, when the members are in the station of close contact, is adapted to face the chair portions and is pivotable to the operative position, so as to receive interiorly, in the operative position, at least a portion of the chair; the seat and backrest portions of the chair member define a closed chamber adapted to be filled with a fluid of a predetermined temperature, so that the chamber may be filled with the fluid to provide comfortable warmth for a person seated on the chair. The chair may be moved into the station of close contact for subsequently bathing the person in the tub, while the tub is in the operative position holding liquid, and while the person is seated on the chair. The tub, after discharge of the liquid may subsequently be returned to its initial position, and the chair and the person sitting thereon may be moved away from the tub.

It is advantageous if the tub member has a wall portion defining an internal surface facing and matching the contour of the external rear surface of the backrest portion, when the chair is received inside the tub member in the operative position thereof.

It is preferable to provide a movable stand for the chair, so that the chair is suspended therefrom.

The chair member preferably includes guidance means cooperating with the wall portion of the tub member, when the tub member is pivoted from the initial position to the operative position, and vice-versa.

It is advantageous if the seat portion of the chair has a recess, and if the tub member further includes two sidewalls disposed opposite and parallel to one another, and if each sidewall is contiguous with the wall portion; the chair member has preferably two sidepanels arranged to be substantially adjacent to sidewalls, respectively, when the tub member is in the operative position.

The tub member has a predetermined volume for receiving the liquid, and the chair member preferably has a liquid-displacement volume of at least 30% of the predetermined volume.

The chair member is preferably composed of one piece, and is also preferably made of plastic; it advantageously includes a separation wall defining together with the seat portion and the backrest portion the chamber.

A chair can alternately be supplied separately for use with a tub pivotable from an initial position to an operative position, and for receiving the chair in the operative position; it includes a seat portion, a backrest portion, and a chamber defined between the seat portion and said backrest portion; the chamber is then arranged to be filled with a fluid of a predetermined temperature, so that a person may be placed on the chair and be comfortably warmed with the aid of the fluid disposed in the chamber, preparatory to the chair being inserted into the tub.

It is advantageous if the front part of the seat portion of the chair has a recess, and if a movable stand is provided to suspend the chair from the stand.

BRIEF DESCRIPTION OF THE DRAWING

For a fuller understanding of the nature and object of the invention, reference should be had to the following detailed description, taken in connection with the accompanying drawings in which.

DESCRIPTION OF THE PREFERRED EMBODIMENTS

Figures 1, 2, 3:
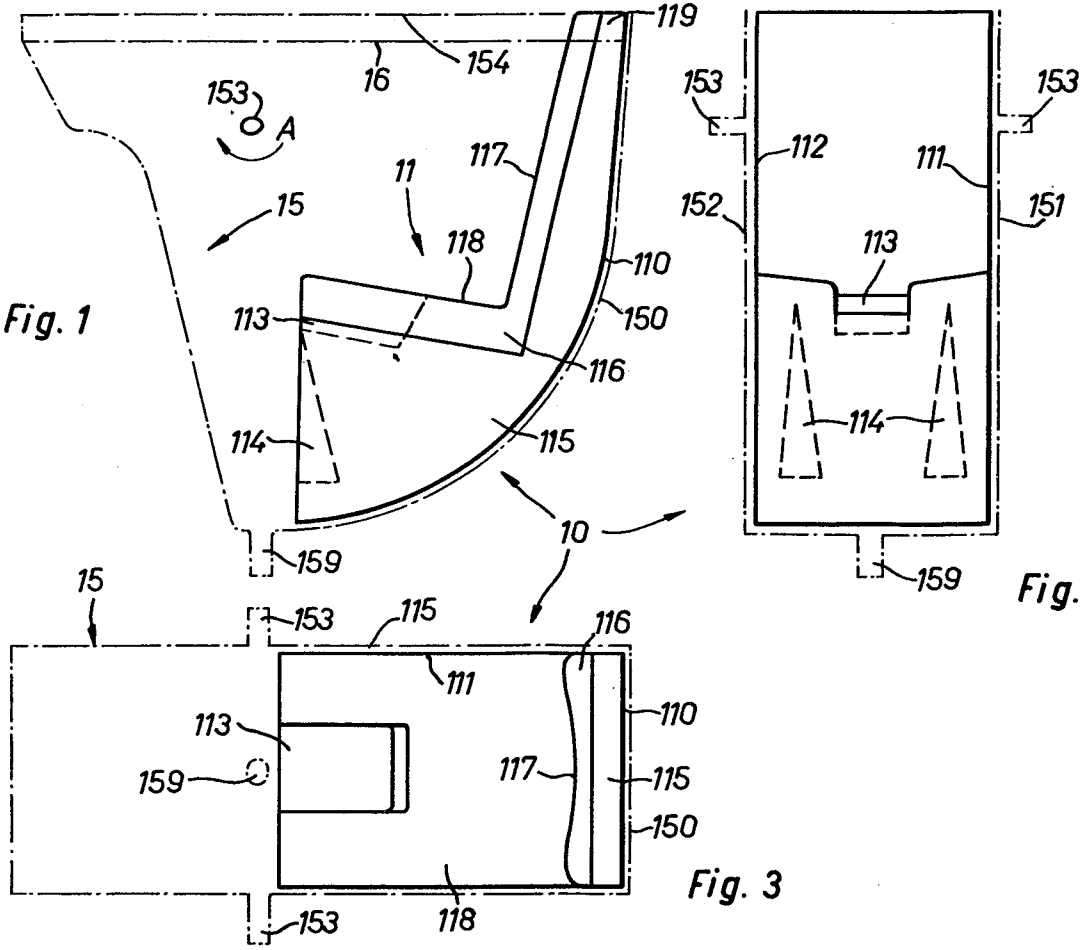
FIG. 1 shows a schematic sideview of the bathing equipment, according to the present invention, including a chair in a tub, the tub being in an operative position.
FIG. 2 shows a front view of the chair in the tub.
FIG. 3 shows a plan view of the chair in the tub.

Referring now to FIG. 1, the bathing equipment 10 includes a chair 11, with a bathtub 15 being shown in dash-dotted lines in its initial position, and in full lines in its operative position; the bathtub 15 includes an outlet 159, which may be opened or closed, the bathtub having an upper rim 154 positioned horizontally when in the operative position.

The tub 15 may be pivoted from its initial or inactive position about a horizontal axle 153, in the direction of the arrow A to its operative position about the chair 11, which chair 11 is fixedly maintained (in a non-illustrated manner) in its place; the tub 15 may then be returned to its initial position by being pivoted about the upper end 119 of the chair 11, until the rim 154 of the tub 15 is disposed again approximately vertically of the chair 11, so that the chair 11 can be removed from the empty tub 15, by being moved sideways.

A backrest 117 preferably extends approximately up to the upper rim 154 of the tub 15, and together with a seat portion 118 of the chair 11, forms an outer surface of a hollow body 116, which hollow body 116 may be filled with warm water. The hollow body 116 is in turn connected to a displacement body 115, or forms a part thereof. The hollow body 116 is equipped with (non-illustrated) inlet and outlet openings. The displacement body 115 may be hollow, or may be filled with a filling material.

It is essential that the displacement body 115 and the hollow body 116 of the chair 11 occupy a substantial part, for example at least 30%, of the inner volume of the tub 15, in a portion of the tub 15 which does not inhibit the mobility of a user, namely in that portion of the tub 15 which is disposed below the seat portion 118, and to the rear of the backrest 117.

Optimal displacement effects can, of course, be obtained by matching the contour of the rear wall 110 of the displacement body 115 to the shape of a corresponding inner wall portion 150 of the tub 15, and by allowing the flat side walls 111 and 112 of the chair 11, or of the hollow body 116, and the displacement body 115 forming part of the chair, to move close to the inner side walls 151 and 152 of the tub 15.

The maximal filling height of the tub 15 is denoted by the line 16. The volume of water required to fill the tub 15 results from the difference between the volume of the tub 15, and the displacement volume of the chair 11, together with a (non-illustrated) person using the chair. A conventional (non-illustrated) outlet can be provided, so that the tub 15 does not overflow.

The inner volume, namely the receiving capability of the hollow body 116, formed partly by the seat portion 118 and the backrest 117, for a volume of water separate from the water required for bathing, and needed to keep the seat portion 118 and the backrest 117 comfortably warm, is advantageously determined, so that the desired surface temperature of the seat portion 118 and of the backrest 117 is 35° to 42° C.; this temperature is maintained during the intended operating cycle, namely during the transport of a patient from his bed to the tub, during the duration of the bath of the patient, and the return of the patient to his bed. In most cases this can be achieved by a warm water volume within the range of 50 to 90 liters.

The seat region of the chair 11 has on its accessible front surface a recess 113, to facilitate washing of the genital region of the patient.

In order to support the feet of the patient, the front side of the displacement body 115 is provided, for example, with recesses 114 in the shape of a half-portion of a cone.

Figure 4:
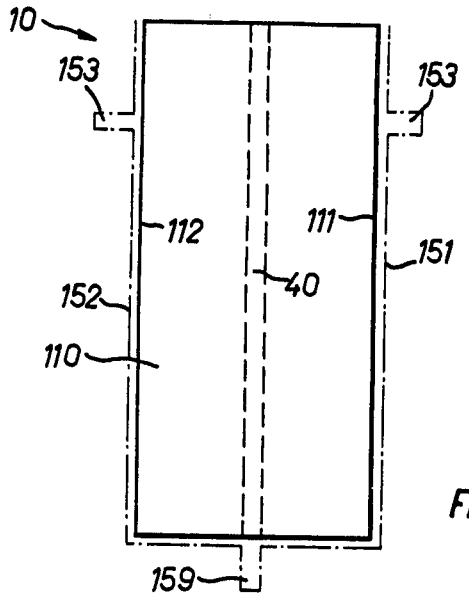
FIG. 4 shows a rear view of the chair in the tub.

In order to improve the relative guidance of the chair 11 and the tub 15, when the tub 15 is pivoted about the horizontal axle 153, and so as to avoid any possible tipping of the bathtub 15, the rear wall 110 of the displacement body 115 may be formed with a guidance groove 40, best seen in FIG. 4, which cooperates with at least one (non-illustrated) longitudinal projection of the inner wall 150 of the tub 15.

Figure 5:
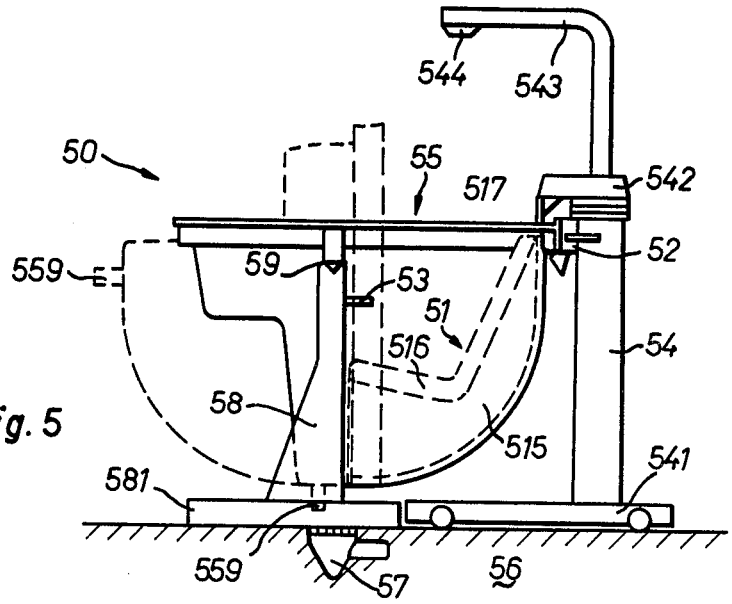
FIG. 5 shows a schematic side view of the entire bathing equipment.

FIG. 5 shows a schematic sideview of a preferred implementation of the bathing equipment 50. A tub 55 is pivotally supported by a horizontal axle 59 on a carrier 58 between an operative or bathing position, shown in full lines, and a non-active or initial position, shown in dot-dash lines; the carrier 58 rests on a base plate 581. The base plate 581 has a (non-illustrated) groove for receiving a discharge conduit 559 of the tub 55, the discharged water passing through an outlet 57 in the floor 56 of the bathroom; this arrangement permits pivoting of the tub 55, without the discharge conduit 559 during the pivotal motion of the tub 55, interfering with the base plate 581.

The chair 51, including the displacement body 515 and the hollow chamber 516, is secured at its upper end through a connecting member 517 to a stand 54; the stand 54 is in turn secured to a movable floor platform 541. The chair 51, whose chamber 516 has previously been filled with warm water of approximately 40° C., can, for example, be rolled to the bed of a patient. The patient may then be placed, if necessary, with the aid of nursing personnel, on the chair 51, and together with the chair 51 can then be transported to the vicinity of the tub 55. The tub 55 is then subsequently pivoted around the chair 51 and the patient sitting thereon, until the tub 55 occupies its operating position; the tub 55 can thereafter be filled via (non-illustrated) conduits with water. A locking arrangement 53 maintains the tub 54 in the operating position. A second locking arrangement 52 is provided to releasably connect the stand 54 to the tub 55.

The stand 54 is preferably provided with a (non-illustrated) pneumatic or hydraulic lifting arrangement, so as to lift the head of the carrier 542, together with the chair 51 secured thereto. A supporting rod 543 is connected to the stand 54, and terminates in a handle 544 for the patient, so that the nursing personnel has access to, and can wash the lower body portion of the patient.

The chair 51 and the patient sitting thereon may then be lowered into the tub 55; after the patient has been bathed, the tub 55 can be emptied of water, through, for example the discharge conduit 559, and subsequently pivoted around the chair 51 to its initial position. The patient may be subsequently transported on the chair 51 to his bed.

The fact that the hollow body 116 has been filled with water insures, during the transport phase of the chair 51 that the seat portion 118 and the backrest 117 are maintained at the desired temperature, so that the patient in turn may be kept comfortably warm following his bath, until he is returned to his bed.

The tub 55 or 15 may be fabricated in a known manner from plastic, for example from glass fiber such as polyester, or from metal. The chair 11 or 51 can also be fabricated of such material. Thermo-plastic or duroplastic synthetic materials are preferred for the chair. The chair may for example, be made in a single piece, including an outer wall, which includes the displacement body 115 or 515, and the hollow chamber 116 or 516, and may additionally be formed with a separating wall between the chamber 516 and the displacement body 515; the chamber 516 may be filled, if desired with aerated plastic foam material, or the like.

Having thus described the invention, What I claim as new and desire to be secured by a Letters Patent is as follows:

1. A bathing equipment, comprising in combination, a tub member pivotable about a horizontal axis between an initial and an operative position, and being adapted to be filled with a bathing liquid when in the operative position, and a chair member having seat and backrest portions, at least one of said members being movable relative to the other to and from a station of close contact, said tub member, when the members are in said station of close contact, being adapted to face said chair portions and being pivotable to said operative position, receiving interiorly, in said operative position, at least a portion of said chair, said seat and backrest portions of said chair member defining a closed chamber adapted to be filled with a fluid of a predetermined temperature, the fluid thereby being in heat exchange contact with a major portion of the body of a person seated on said chair member, whereby said chamber may be filled with said fluid to provide comfortable warmth to the major portion of the body of a person seated on said chair member, preparatory to said chair member being moved into the tub member, whereafter said chair member may be moved into said station of close contact for subsequently bathing said person in the tub member in the operative position holding liquid, while seated on the chair member, said tub member after discharge of the liquid may subsequently be returned to its initial position, and the chair member and the person sitting thereon be moved away from said tub member, wherein said tub member has a wall portion defining an internal surface facing and matching the contour of the external rear surface of said backrest portion when said chair is received inside the tub member in said operative position thereof, and wherein said tub member has a predetermined volume for receiving said liquid, and wherein said chair member has a liquid-displacement volume of at least 30% of said predetermined volume.

2. A bathing equipment as claimed in claim 1 further comprising a movable stand, said chair member being suspended from said movable stand.

3. A bathing equipment as claimed in claim 1, wherein said chair member includes guidance means cooperating with the wall portion of said tub member, when said tub member is pivoted from said initial position to said operative position, and vice-versa.

4. A bathing equipment as claimed in claim 1, wherein said seat portion has a front part, said front part having a recess.

5. A bathing equipment as claimed in claim 1, wherein said tub member further comprises two sidewalls disposed opposite and parallel to one another, each sidewall being contiguous with said wall portion, and wherein said chair member has two sidepanels arranged to be substantially adjacent said sidewalls, respectively, when said tub member is in said operative position.

6. A bathing equipment as claimed in claim 1, wherein said chair member is composed of one piece and is made of plastic, and further including a separation wall defining together with said seat portion and said backrest portion said chamber.

7. A chair as claimed in claim 1, wherein the seat portion of said chair has a front part, said front part having a recess, and further comprising a movable stand, said chair being suspended from said stand.

* * * * *